US009816498B2

(12) United States Patent
Suzuki et al.

(10) Patent No.: US 9,816,498 B2
(45) **Date of Patent: *Nov. 14, 2017**

(54) VARIABLE DISPLACEMENT SWASH-PLATE COMPRESSOR

(71) Applicant: KABUSHIKI KAISHA TOYOTA JIDOSHOKKI, Aichi-ken (JP)

(72) Inventors: Takahiro Suzuki, Kariya (JP); Shinya Yamamoto, Kariya (JP); Hideharu Yamashita, Kariya (JP); Kazunari Honda, Kariya (JP); Kei Nishii, Kariya (JP); Masaki Ota, Kariya (JP); Yusuke Yamazaki, Kariya (JP)

(73) Assignee: KABUSHIKI KAISHA TOYOTA JIDOSHOKKI, Aichi-Ken (JP)

( * ) Notice: Subject to any disclaimer, the term of this patent is extended or adjusted under 35 U.S.C. 154(b) by 147 days.

This patent is subject to a terminal disclaimer.

(21) Appl. No.: 14/778,792

(22) PCT Filed: Mar. 26, 2014

(86) PCT No.: PCT/JP2014/058471
§ 371 (c)(1),
(2) Date: Sep. 21, 2015

(87) PCT Pub. No.: WO2014/157311
PCT Pub. Date: Oct. 2, 2014

(65) Prior Publication Data

US 2016/0047367 A1 Feb. 18, 2016

(30) Foreign Application Priority Data

Mar. 29, 2013 (JP) ..... 2013-073819
Mar. 10, 2014 (JP) ..... 2014-046562

(51) Int. Cl.
*F04B 1/26* (2006.01)
*F04B 27/20* (2006.01)
(Continued)

(52) U.S. Cl.
CPC ..... *F04B 27/20* (2013.01); *F04B 27/086* (2013.01); *F04B 27/1045* (2013.01);
(Continued)

(58) Field of Classification Search
CPC .... F04B 27/20; F04B 27/086; F04B 27/1045; F04B 27/1054; F04B 27/1072; F04B 27/18; F04B 27/1081
See application file for complete search history.

(56) References Cited

U.S. PATENT DOCUMENTS 3,062,020 A 11/1962 Heidorn
3,575,534 A 4/1971 Leduc
(Continued)

FOREIGN PATENT DOCUMENTS

JP 52-131204 11/1977
JP 54-51013 4/1979
(Continued)

OTHER PUBLICATIONS

International Search Report, with English-language translation thereof, for PCT/JP2014/058471 dated Jul. 8, 2014.
(Continued)

*Primary Examiner* — Charles Freay
(74) *Attorney, Agent, or Firm* — Greenblum & Bernstein, P.L.C.

(57) ABSTRACT

A variable displacement swash plate type compressor includes a rotary shaft, a swash plate, and an actuator, which changes the inclination angle of the swash plate. The actuator includes a partition body and a movable body, which moves in a direction along the rotational axis of the rotary
(Continued)

shaft. The movable body includes a guide surface, which changes the inclination angle of the swash plate, and a sliding portion, which slides on the rotary shaft or on the partition body. When viewed from a direction that is perpendicular to the direction in which the rotational axis of the rotary shaft extends and perpendicular to a first direction, the guide surface is configured such that a perpendicular line or a normal line to the guide surface intersects with the rotational axis of the rotary shaft in a zone surrounded by the sliding portion.

7 Claims, 7 Drawing Sheets

(51) Int. Cl.
*F04B 27/10* (2006.01)
*F04B 27/18* (2006.01)
*F04B 27/08* (2006.01)

(52) U.S. Cl.
CPC ..... *F04B 27/1054* (2013.01); *F04B 27/1072* (2013.01); *F04B 27/1081* (2013.01); *F04B 27/18* (2013.01)

(56) References Cited

U.S. PATENT DOCUMENTS

| | | | | |
|---|---|---|---|---|
| 4,037,993 | A | 7/1977 | Roberts | |
| 4,145,163 | A | 3/1979 | Fogelberg et al. | |
| 4,149,830 | A | 4/1979 | Woodruff | |
| 4,836,090 | A * | 6/1989 | Smith | F04B 27/1072 417/222.2 |
| 4,886,423 | A | 12/1989 | Iwanami et al. | |
| 4,963,074 | A * | 10/1990 | Sanuki | F04B 27/18 417/222.1 |
| 5,002,466 | A * | 3/1991 | Inagaki | F04B 27/1072 417/222.1 |
| 5,032,060 | A * | 7/1991 | Kobayashi | F04B 27/12 417/222.1 |
| 5,259,736 | A * | 11/1993 | Terauchi | F01B 3/106 417/222.1 |
| 5,370,503 | A | 12/1994 | Terauchi | |
| 5,380,166 | A * | 1/1995 | Terauchi | F04B 27/0878 417/269 |
| 5,529,461 | A | 6/1996 | Kawaguchi et al. | |
| 6,024,008 | A | 2/2000 | Kawaguchi et al. | |
| 6,742,439 | B2 | 6/2004 | Matsuda et al. | |
| 6,957,604 | B1 | 10/2005 | Tiedemann et al. | |
| 9,309,875 | B2 * | 4/2016 | Yamamoto | F04B 27/1804 |
| 9,316,217 | B2 * | 4/2016 | Yamamoto | F04B 27/1804 |
| 2003/0223887 | A1 * | 12/2003 | Kawano | F04B 27/1072 417/269 |
| 2012/0073430 | A1 | 3/2012 | Uchikado | |
| 2014/0127044 | A1 | 5/2014 | Yamamoto et al. | |
| 2015/0252798 | A1 | 9/2015 | Suzuki et al. | |

FOREIGN PATENT DOCUMENTS

| | | |
|---|---|---|
| JP | 58-162780 | 9/1983 |
| JP | 64-41680 | 2/1989 |
| JP | 1-147171 | 6/1989 |
| JP | 2-16374 | 1/1990 |
| JP | 2-19665 | 1/1990 |
| JP | 3-10082 | 1/1991 |
| JP | 4-54287 | 2/1992 |
| JP | 4-279776 | 10/1992 |
| JP | 5-18355 | 1/1993 |
| JP | 5-172052 | 7/1993 |
| JP | 5-240160 | 9/1993 |
| JP | 7-189902 | 7/1995 |
| JP | 10-141221 | 5/1998 |
| JP | 10-205440 | 8/1998 |
| JP | 2003-507627 | 2/2003 |
| JP | 2004-52623 | 2/2004 |
| JP | 2007-239722 | 9/2007 |
| JP | 2010-281289 | 12/2010 |
| JP | 2014-92104 | 5/2014 |

OTHER PUBLICATIONS

Official Action, with English-language translation thereof, for CN Pat. App. No. 201410116616.5 dated Nov. 4, 2015.
English-language translation of International Preliminary Report on Patentability for PCT/JP2014/058471 dated Sep. 29, 2015.
Official Action in U.S. Appl. No. 14/227,055 dated Aug. 26, 2016.
Official Action issued in DE Appl. No. 11 2014 001 751.5 dated Aug. 16, 2017.

* cited by examiner

VARIABLE DISPLACEMENT SWASH-PLATE COMPRESSOR

TECHNICAL FIELD

The present invention relates to a variable displacement swash plate type compressor.

BACKGROUND ART

Patent Document 1 discloses an example of variable displacement swash plate type compressor, which has a movable body that moves along the axis of a rotary shaft to change the inclination angle of the swash plate. As control gas is introduced to a control pressure chamber in the housing, the pressure inside the control pressure chamber is changed. This allows the movable body to move along the axis of the rotary shaft. As the movable body is moved along the axis of the rotary shaft, the movable body applies to a central portion of the swash plate a force that changes the inclination angle of the swash plate. Accordingly, the inclination of the swash plate is changed.

PRIOR ART DOCUMENT

Patent Document

Patent Document 1: Japanese Laid-Open Patent Publication No. 52-131204

SUMMARY OF THE INVENTION

Problems that the Invention is to Solve

In the configuration in which a movable body applies a force that changes the inclination angle of a swash plate to a central portion of the swash plate as in Patent Document 1, a great force is required for changing the inclination angle of the swash plate. In this regard, for example, a movable body may apply a force that changes the inclination angle of a swash plate to a peripheral portion of the swash plate. In this case, compared to a case in which a movable body applies a force for changing the swash plate inclination angle to the central portion of the swash plate, the inclination angle can be changed by a small force. This reduces the flow rate of control gas that needs to be introduced to a control pressure chamber to change the inclination angle of the swash plate.

However, in the configuration in which the movable body applies a force for changing the inclination angle of the swash plate to the peripheral portion of the swash plate, a change in the inclination angle of the swash plate causes the movable body to receive a moment that acts to tilt the movable body with respect to the moving direction. If the movable body tilts with respect to the moving direction, a force that supports the tilting motion of the movable body is generated between the movable body and the rotary shaft while the movable body and the rotary shaft are contacting each other at two contact points on the opposite sides of the rotary shaft. The friction caused by the force generates a twist between the movable body and the rotary shaft. The twist increases, for example, the sliding resistance, hindering smooth movement of the movable body along the axis of the rotary shaft. This hampers smooth change in the inclination angle of the swash plate.

Accordingly, it is an objective of the present invention to provide a variable displacement swash plate type compressor that smoothly changes the inclination angle of the swash plate.

Means for Solving the Problems

To achieve the foregoing objective and in accordance with the present invention, a variable displacement swash plate type compressor is provided that includes a housing, a rotary shaft, a swash plate, a link mechanism, a piston, a conversion mechanism, an actuator, and a control mechanism. The housing has a suction chamber, a discharge chamber, a swash plate chamber communicating with the suction chamber, and a cylinder bore. The rotary shaft is rotationally supported by the housing. The swash plate is rotational in the swash plate chamber by rotation of the rotary shaft. The link mechanism is arranged between the rotary shaft and the swash plate and allows change of an inclination angle of the swash plate with respect to a first direction that is perpendicular to a rotational axis of the rotary shaft. The piston is reciprocally received in the cylinder bore. The conversion mechanism causes the piston to reciprocate in the cylinder bore by a stroke corresponding to the inclination angle of the swash plate through rotation of the swash plate. The actuator is located in the swash plate chamber and changes the inclination angle of the swash plate. The control mechanism controls the actuator. The actuator includes a partition body provided on the rotary shaft, a movable body, which is located in the swash plate chamber and movable along the rotational axis of the rotary shaft, a control pressure chamber, which is defined by the partition body and the movable body and moves the movable body by introducing refrigerant from the discharge chamber, and a coupling member, which is located between the movable body and the swash plate and in a peripheral portion of the swash plate. The movable body includes a guide surface, which guides the coupling member and changes the inclination angle of the swash plate as the movable body moves along the rotational axis of the rotary shaft, and a sliding portion, which slides on the rotary shaft or the partition body as the movable body moves along the rotational axis of the rotary shaft. The guide surface is configured such that a perpendicular line or a normal line to the guide surface and the rotational axis of the rotary shaft intersect with each other in a zone surrounded by the sliding portion when viewed in a direction that is perpendicular to a direction in which the rotational axis of the rotary shaft extends and perpendicular to the first direction.

MODES FOR CARRYING OUT THE INVENTION

A variable displacement swash plate type compressor according to one embodiment will now be described with reference to FIGS. 1 to 4. The variable displacement swash plate type compressor is used in a vehicle air conditioner.

Figure 1:
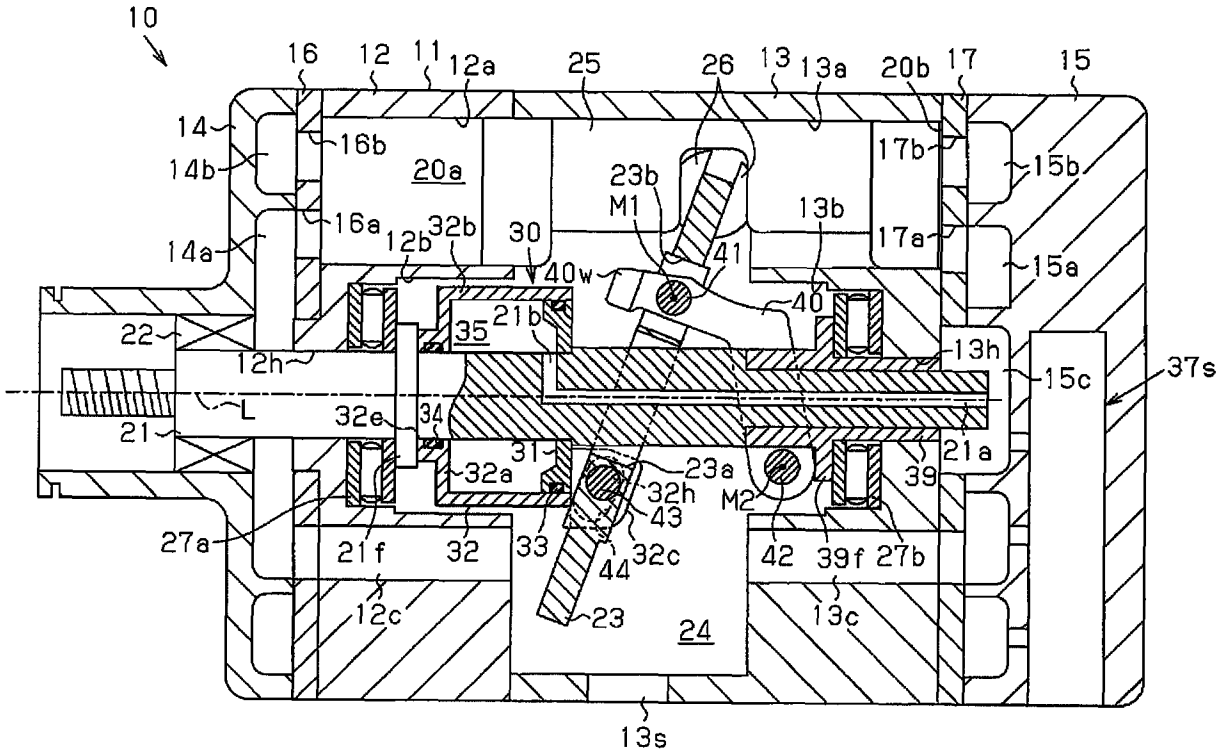
FIG. 1 is a cross-sectional side view illustrating a variable displacement swash plate type compressor according to one embodiment.

As shown in FIG. 1, a variable displacement swash plate type compressor 10 includes a housing 11, which has a first cylinder block 12 located on the front side (a first side) and a second cylinder block 13 located on the rear side (a second side). The first and second cylinder blocks 12, 13 are joined to each other. The housing 11 further includes a front housing member 14 joined to the first cylinder block 12 and a rear housing member 15 joined to the second cylinder block 13.

A first valve plate 16 is arranged between the front housing member 14 and the first cylinder block 12. Further, a second valve plate 17 is arranged between the rear housing member 15 and the second cylinder block 13.

A suction chamber 14*a* and a discharge chamber 14*b* are defined between the front housing member 14 and the first valve plate 16. The discharge chamber 14*b* is located radially outward of the suction chamber 14*a*. Likewise, a suction chamber 15*a* and a discharge chamber 15*b* are defined between the rear housing member 15 and the second valve plate 17. Additionally, a pressure adjusting chamber 15*c* is arranged in the rear housing member 15. The pressure adjusting chamber 15*c* is located at the center of the rear housing member 15, and the suction chamber 15*a* is located radially outward of the pressure adjusting chamber 15*c*. The discharge chamber 15*b* is located radially outward of the suction chamber 15*a*. The discharge chambers 14*b*, 15*b* are connected to each other through a discharge passage (not shown). The discharge passage is in turn connected to an external refrigerant circuit (not shown). The discharge chambers 14*b*, 15*b* are in a discharge pressure zone.

The first valve plate 16 has suction ports 16*a* connected to the suction chamber 14*a* and discharge ports 16*b* connected to the discharge chamber 14*b*. The second valve plate 17 has suction ports 17*a* connected to the suction chamber 15*a* and discharge ports 17*b* connected to the discharge chamber 15*b*. A suction valve mechanism (not shown) is arranged in each of the suction ports 16*a*, 17*a*. A discharge valve mechanism (not shown) is arranged in each of the discharge ports 16*b*, 17*b*.

A rotary shaft 21 is rotationally supported in the housing 11. A part of the rotary shaft 21 on the front side (first side) extends through a shaft hole 12*h*, which is provided in the first cylinder block 12. Specifically, the front part of the rotary shaft 21 is located on the first side in the direction in which the rotation axis L of the rotary shaft 21 extends (the axial direction of the rotary shaft 21). The front end of the rotary shaft 21 is located in the front housing member 14. A part of the rotary shaft 21 on the rear side (second side) extends through a shaft hole 13*h*, which is provided in the second cylinder block 13. Specifically, the rear part of the rotary shaft 21 is a part of the rotary shaft 21 that is located on the second side in the direction in which the rotation axis L of the rotary shaft 21 extends. The rear end of the rotary shaft 21 is located in the pressure adjusting chamber 15*c*.

The front part of the rotary shaft 21 is rotationally supported by the first cylinder block 12 via the shaft hole 12*h*. The rear part of the rotary shaft 21 is rotationally supported by the second cylinder block 13 via the shaft hole 13*h*. A sealing device 22 of lip seal type is located between the front housing member 14 and the rotary shaft 21. The front end of the rotary shaft 21 is coupled to an external drive source, which is a vehicle engine in this embodiment, through a power transmission mechanism (not shown). In the present embodiment, the power transmission mechanism is a clutchless mechanism (for example, a combination of a belt and pulleys), which constantly transmits power.

In the housing 11, the first cylinder block 12 and the second cylinder block 13 define a swash plate chamber 24. The swash plate chamber 24 accommodates a swash plate 23, which rotates when receiving drive force from the rotary shaft 21 and is tiltable along the axis of the rotary shaft 21. The swash plate 23 has a through hole 23*a*, through which the rotary shaft 21 extends. The swash plate 23 is assembled to the rotary shaft 21 by inserting the rotary shaft 21 into the through hole 23*a*.

The first cylinder block 12 has first cylinder bores 12*a*, which extend along the axis of the first cylinder block 12 and are arranged about the rotary shaft 21. Only one of the first cylinder bores 12*a* is shown in FIG. 1. Each first cylinder bore 12*a* is connected to the suction chamber 14*a* via the corresponding suction port 16*a* and is connected to the discharge chamber 14*b* via the corresponding discharge port 16*b*. The second cylinder block 13 has second cylinder bores 13*a*, which extend along the axis of the second cylinder block 13 and are arranged about the rotary shaft 21. Only one of the second cylinder bores 13*a* is shown in FIG. 1. Each second cylinder bore 13*a* is connected to the suction chamber 15*a* via the corresponding suction port 17*a* and is connected to the discharge chamber 15*b* via the corresponding discharge port 17*b*. The first cylinder bores 12*a* and the second cylinder bores 13*a* are arranged to make front-rear pairs. Each pair of the first cylinder bore 12*a* and the second cylinder bore 13*a* accommodates a double-headed piston 25, while permitting the piston 25 to reciprocate in the front-rear direction. That is, the variable displacement swash plate type compressor 10 of the present embodiment is a double-headed piston swash plate type compressor.

Each double-headed piston 25 is engaged with the periphery of the swash plate 23 with two shoes 26. The shoes 26 convert rotation of the swash plate 23, which rotates with the rotary shaft 21, to linear reciprocation of the double-headed pistons 25. Thus, the pairs of the shoes 26 function as a conversion mechanism that reciprocates the double-headed pistons 25 in the pairs of the first cylinder bores 12*a* and the second cylinder bores 13*a* as the swash plate 23 rotates. In each first cylinder bore 12*a*, a first compression chamber 20*a* is defined by the double-headed piston 25 and the first valve plate 16. In each second cylinder bore 13*a*, a second compression chamber 20*b* is defined by the double-headed piston 25 and the second valve plate 17.

The first cylinder block 12 has a first large diameter hole 12*b*, which is continuous with the shaft hole 12*h* and has a larger diameter than the shaft hole 12*h*. The first large diameter hole 12*b* communicates with the swash plate chamber 24. The swash plate chamber 24 and the suction chamber 14*a* are connected to each other by a suction passage 12*c*, which extends through the first cylinder block 12 and the first valve plate 16.

The second cylinder block 13 has a second large diameter hole 13*b*, which is continuous with the shaft hole 13*h* and has a larger diameter than the shaft hole 13*h*. The second large diameter hole 13*b* communicates with the swash plate chamber 24. The swash plate chamber 24 and the suction chamber 15*a* are connected to each other by a suction passage 13*c*, which extends through the second cylinder block 13 and the second valve plate 17.

A suction inlet 13*s* is provided in the peripheral wall of the second cylinder block 13. The suction inlet 13*s* is connected to an external refrigerant circuit. Refrigerant gas is drawn into the swash plate chamber 24 from the external refrigerant circuit via the suction inlet 13*s* and is then drawn into the suction chambers 14*a*, 15*a* via the suction passages 12*c*, 13*c*. The suction chambers 14*a*, 15*a* and the swash plate chamber 24 are therefore in a suction pressure zone. The pressure in the suction chambers 14*a*, 15*a* and the pressure in the swash plate chamber 24 are substantially equal to each other.

The rotary shaft 21 has an annular flange portion 21*f*, which is arranged in the first large diameter hole 12*b* and extends radially outward. With respect to the axial direction of the rotary shaft 21, a first thrust bearing 27*a* is arranged between the flange portion 21*f* and the first cylinder block 12. A cylindrical supporting member 39 is press fitted to a rear portion of the rotary shaft 21. The supporting member 39 has an annular flange portion 39*f*, which is arranged in the second large diameter hole 13*b* and extends radially outward. With respect to the axial direction of the rotary shaft 21, a second thrust bearing 27*b* is arranged between the flange portion 39*f* and the second cylinder block 13.

The swash plate chamber 24 accommodates an actuator 30. The actuator 30 changes the inclination angle of the swash plate 23 with respect to a first direction (the vertical direction as viewed in FIG. 1), which is perpendicular to the rotational axis L of the rotary shaft 21 in the swash plate 23. The actuator 30 is arranged on the rotary shaft 21 at a position rearward of the flange portion 21*f* and forward of the swash plate 23 and has an annular partition body 31, which is integrally rotational with the rotary shaft 21. The actuator 30 also has a cylindrical movable body 32, which has a closed end and is located between the flange portion 21*f* and the partition body 31. The movable body 32 is movable along the axis of the rotary shaft 21 in the swash plate chamber 24.

The movable body 32 includes an annular bottom portion 32*a* and a cylindrical portion 32*b*. The bottom portion 32*a* has a through hole 32*e*, through which the rotary shaft 21 extends. The cylindrical portion 32*b* extends along the axis of the rotary shaft 21 from the outer periphery of the bottom portion 32*a*. The inner circumferential surface of the cylindrical portion 32*b* is slidable along the outer periphery of the partition body 31. This allows the movable body 32 to rotate integrally with the rotary shaft 21 via the partition body 31. The clearance between the inner circumferential surface of the cylindrical portion 32*b* and the outer periphery of the partition body 31 is sealed with a sealing member 33. Likewise, the clearance between the through hole 32*e* and the rotary shaft 21 is sealed with a sealing member 34. The actuator 30 has a control pressure chamber 35 defined by the partition body 31 and the movable body 32.

The rotary shaft 21 has a first in-shaft passage 21*a*, which extends along the axis of the rotary shaft 21. The rear end of the first in-shaft passage 21*a* opens to the pressure adjusting chamber 15*c*. The rotary shaft 21 further has a second in-shaft passage 21*b*, which extends in the radial direction of the rotary shaft 21. One end of the second in-shaft passage 21*b* communicates with the distal end of the first in-shaft passage 21*a*. The other end of the second in-shaft passage 21*b* opens to the control pressure chamber 35. Accordingly, the control pressure chamber 35 and the pressure adjusting chamber 15*c* are connected to each other by the first in-shaft passage 21*a* and the second in-shaft passage 21*b*.

Figure 2:
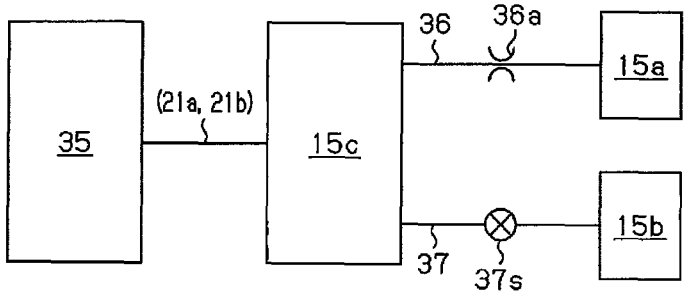
FIG. 2 is a diagram showing the relationship among a control pressure chamber, a pressure adjusting chamber, a suction chamber, and a discharge chamber.

As shown in FIG. 2, the pressure adjusting chamber 15*c* and the suction chamber 15*a* are connected to each other by a bleed passage 36. The bleed passage 36 has an orifice 36*a*, which restricts the flow rate of refrigerant gas flowing in the bleed passage 36. The pressure adjusting chamber 15*c* and the discharge chamber 15*b* are connected to each other by a supply passage 37. An electromagnetic control valve 37*s*, which serves as a control mechanism for controlling the actuator 30, is arranged in the supply passage 37. The control valve 37*s* is configured to adjust the opening degree of the supply passage 37 based on the pressure in the suction chamber 15*a*. The control valve 37*s* adjusts the flow rate of refrigerant gas flowing in the supply passage 37.

Refrigerant gas is introduced to the control pressure chamber 35 from the discharge chamber 15*b* via the supply passage 37, the pressure adjusting chamber 15*c*, the first in-shaft passage 21*a*, and the second in-shaft passage 21*b*. Refrigerant gas in the control pressure chamber 35 is discharged to the suction chamber 15*a* via the second in-shaft passage 21*b*, the first in-shaft passage 21*a*, the pressure adjusting chamber 15*c*, and the bleed passage 36. The introduction and discharge of refrigerant gas changes the pressure in the control pressure chamber 35. The pressure difference between the control pressure chamber 35 and the swash plate chamber 24 causes the movable body 32 to move along the axis of the rotary shaft 21 with respect to the partition body 31. The refrigerant gas introduced into the control pressure chamber 35 serves as control gas for controlling the movement of the movable body 32.

Referring to FIG. 1, in the swash plate chamber 24, a lug arm 40 is provided between the swash plate 23 and the flange portion 39*f*. The lug arm 40 serves as a link mechanism that allows change of the inclination angle of the swash plate 23. The lug arm 40 substantially has an L shape extending from a first end to a second end. The lug arm 40 has a weight portion 40*w* at the first end. The weight portion 40*w* is located at a position beyond the groove 23*b* of the swash plate 23 and forward of the swash plate 23.

A part of the lug arm 40 on the first side (the front side) is coupled to a part of the swash plate 23 at the upper end (the upper side as viewed in FIG. 1) by a columnar first pin 41, which extends across the groove 23*b*. The part of the lug arm 40 on the second side (the rear side) is supported by the swash plate 23 to about a first swing axis M1, which coincides with the axis of the first pin 41. The part of the lug arm 40 on the second side is coupled to the supporting member 39 by a columnar second pin 42. Thus, the part of the lug arm 40 on the second side is supported by the supporting member 39 to swing about a second swing axis M2, which coincides with the axis of the second pin 42.

A coupling portion 32*c* is provided at the distal end of the cylindrical portion 32*b* of the movable body 32. The coupling portion 32*c* protrudes toward the swash plate 23. The coupling portion 32*c* has an elongated through hole 32*h* for receiving a columnar coupling pin 43. The coupling pin 43, which serves as a coupling member, is located at the lower end of the swash plate 23 (the lower side as viewed in FIG. 1) in the peripheral portion of the swash plate 23. The coupling pin 43 is press fitted to the lower end of the swash plate 23. The coupling pin 43 couples the coupling portion 32*c* to the lower end of the swash plate 23. The coupling pin 43 is slidably supported by the through hole 32*h*.

Figure 3:
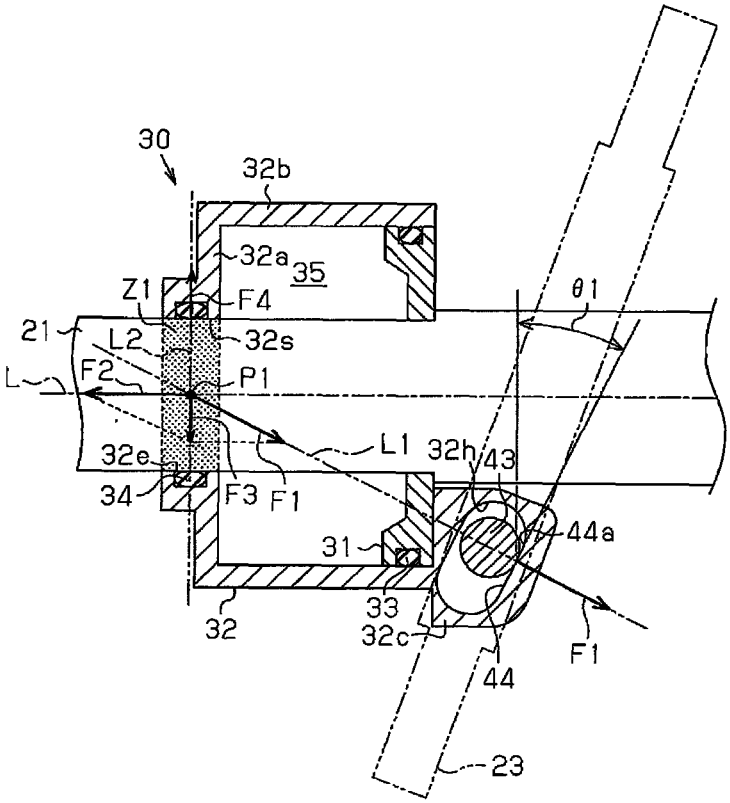
FIG. 3 is a cross-sectional side view illustrating a coupling pin and its surroundings.

As shown in FIG. 3, the through hole 32*h* has a guide surface 44, which guides the coupling pin 43 and changes the inclination angle of the swash plate 23 as the movable body 32 moves along the axis of the rotary shaft 21. The guide surface 44 is located on the opposite side of the through hole 32*h* with respect to the movable body 32. The guide surface 44 has a flat section 44*a*, which is inclined with respect to the moving direction of the movable body 32 (the axis of the rotary shaft 21). The flat section 44*a* extends linearly such that the distance from the rotation axis L of the rotary shaft 21 decreases as the distance from the movable body 32 increases.

The movable body 32 has a sliding portion 32*s*, which slides along the rotary shaft 21 as the movable body 32 moves along the axis of the rotary shaft 21. In the present embodiment, the sliding portion 32*s* is the inner circumferential surface of the through hole 32*e* and extends along the axis of the rotary shaft 21.

The point at which a perpendicular line L1 to the flat section 44*a* intersects the rotational axis L of the rotary shaft 21 as the inclination angle of the swash plate 23 changes is defined as an intersection P1. A force F1, which is applied to the movable body 32 by the coupling pin 43 in the flat section 44*a*, is generated on the perpendicular line L1. The gradient θ1 of the flat section 44*a* is determined such that, when the inclination angle of the swash plate 23 is the maximum inclination angle, the intersection P1 is located in a zone Z1, which is surrounded by the sliding portion 32*s* when viewed in a direction that is perpendicular to the rotational axis L of the rotary shaft 21 and perpendicular to the first direction (that is, as viewed in the direction that is perpendicular to the sheet of FIG. 3 and directed away from the viewer). The gradient θ1 refers to the tilt with respect to the direction perpendicular to the axis of the rotary shaft 21. The zone Z1 is a zone through which the sliding portion 32*s* extends in the axial direction of the rotary shaft 21 and is indicated by a dotted region in FIG. 3.

In the variable displacement swash plate type compressor 10 having the above described configuration, reduction in the opening degree of the control valve 37*s* reduces the flow rate of refrigerant gas that is delivered to the control pressure chamber 35 from the discharge chamber 15*b* via the supply passage 37, the pressure adjusting chamber 15*c*, the first in-shaft passage 21*a*, and the second in-shaft passage 21*b*. Since the refrigerant gas in the control pressure chamber 35 is discharged to the suction chamber 15*a* via the second in-shaft passage 21*b*, the first in-shaft passage 21*a*, the pressure adjusting chamber 15*c*, and the bleed passage 36, the pressure in the control pressure chamber 35 and the pressure in the suction chamber 15*a* are substantially equalized. Since the pressure difference between the control pressure chamber 35 and the swash plate chamber 24 is reduced, the compression reactive force acting on the swash plate 23 from the double-headed pistons 25 causes the swash plate 23 to pull the movable body 32 via the coupling pin 43. This moves the movable body 32 such that the bottom portion 32*a* of the movable body 32 approaches the partition body 31.

Figure 4:
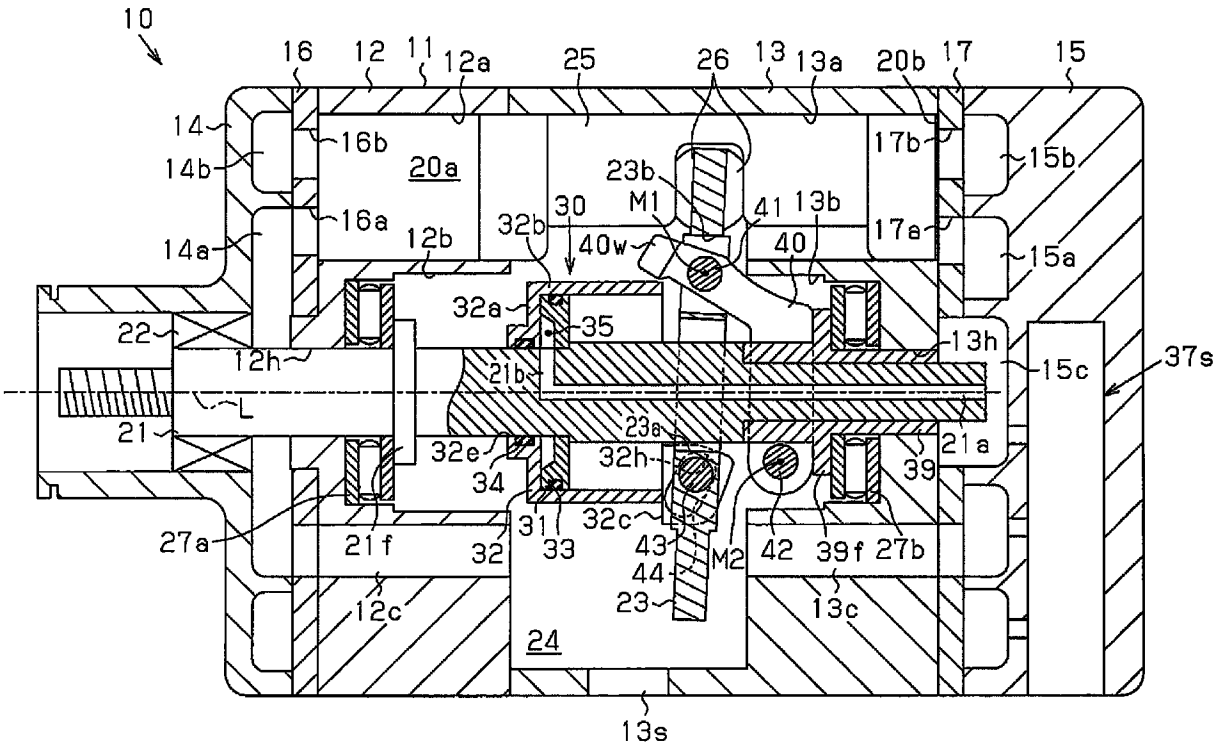
FIG. 4 is a cross-sectional side view illustrating the variable displacement swash plate type compressor when the swash plate is at the minimum inclination angle.

When the movable body 32 is moved such that the bottom portion 32*a* of the movable body 32 approaches the partition body 31 as shown in FIG. 4, the coupling pin 43 slides inside the through hole 32*h* and the swash plate 23 swings about the first swing axis M1. As the swash plate 23 swings about the first swing axis M1, the lug arm 40 swings about the second swing axis M2 to approach the flange portion 39*f*. This reduces the inclination angle of the swash plate 23 and thus reduces the stroke of the double-headed pistons 25. Accordingly, the displacement is decreased.

Increase in the opening degree of the control valve 37*s* increases the flow rate of refrigerant gas that is delivered to the control pressure chamber 35 from the discharge chamber 15*b* via the supply passage 37, the pressure adjusting chamber 15*c*, the first in-shaft passage 21*a*, and the second in-shaft passage 21*b*. This substantially equalizes the pressure in the control pressure chamber 35 with the pressure in the discharge chamber 15*b*. Thus, when the pressure difference between the control pressure chamber 35 and the swash plate chamber 24 increases, the movable body 32 is moved such that the bottom portion 32*a* of the movable body 32 is separated away from the partition body 31, while pulling the swash plate 23 via the coupling pin 43.

When the movable body 32 is moved such that the bottom portion 32*a* of the movable body 32 is separated away from the partition body 31 as shown in FIG. 1, the coupling pin 43 slides inside the through hole 32*h* and the swash plate 23 swings about the first swing axis M1 in a direction opposite to the swinging direction for decreasing the inclination angle of the swash plate 23. As the swash plate 23 swings about the first swing axis M1 in a direction opposite to the inclination angle decreasing direction, the lug arm 40 swings about the second swing axis M2 in a direction opposite to the swinging direction for decreasing the inclination angle of the swash plate 23. This moves the lug arm 40 away from the flange portion 39*f*. This increases the inclination angle of the swash plate 23 and thus increases the stroke of the double-headed pistons 25. Accordingly, the displacement is increased.

Operation of the present embodiment will now be described.

As shown in FIG. 3, when the inclination angle of the swash plate 23 changes, the intersection P1 is located in the zone Z1, which is surrounded by the sliding portion 32*s*, at which the rotary shaft 21 and the movable body 32 slide on each other, with respect to the axial direction of the rotary shaft 21. At this time, a resultant force F3 is generated on a vertical line L2, which includes the intersection P1. The resultant force F3 is obtained by combining the force F1, which is applied to the movable body 32 by the coupling pin 43 in the flat section 44*a*, and a force F2, which is generated by the pressure in the control pressure chamber 35 to move the movable body 32 along the axis of the rotary shaft 21. A force F4 that acts in the opposite direction and balances with the resultant force F3 is also generated on the vertical line L2. As a result, all the forces acting on the movable body 32 are generated on the vertical line L2, which includes the intersection P1, and balance out, and no moment is generated that acts to tilt the movable body 32 with respect to the moving direction. This allows the inclination angle of the swash plate 23 to be changed smoothly.

The flat section 44*a* is configured such that, when the swash plate 23 is at the maximum inclination angle, the intersection P1 is located in the zone Z1, which is surrounded by the sliding portion 32*s*. Thus, at the maximum inclination angle, or when the movable body 32 generates the greatest drive force, no moment is generated that acts to tilt the movable body 32 with respect to the moving direction. As a result, the inclination angle of the swash plate 23 is readily changed to the maximum inclination angle. Also, the inclination angle of the swash plate 23 is decreased smoothly from the maximum inclination angle.

The above described embodiment provides the following advantages.

(1) The flat section 44*a* is configured, that is, the gradient of the flat section 44*a* is set such that the perpendicular line L1 to the flat section 44*a* and the rotational axis L of the rotary shaft 21 intersect with each other in the zone Z1, which is surrounded by the sliding portion 32*s*, when viewed in a direction that is perpendicular to the rotational axis L of the rotary shaft 21 and perpendicular to the first direction.

According to this configuration, when the inclination angle of the swash plate 23 is changed, the intersection P1 of the perpendicular line L1 to the flat section 44*a* and the rotational axis L of the rotary shaft 21 is located in the zone Z1, which is surrounded by the sliding portion 32*s*, at which the rotary shaft 21 and the movable body 32 slide on each other, with respect to the axial direction of the rotary shaft 21. At this time, the force F1, which is applied to the movable body 32 by the coupling pin 43 in the flat section 44*a*, is generated on the perpendicular line L1. The resultant force F3 of the force F1 and the force F2, which is generated by the pressure in the control pressure chamber 35 to move the movable body 32 along the axis of the rotary shaft 21, is generated on the vertical line L2, which includes the intersection P1. The force F4, which acts in the opposite direction of and balances with the resultant force F3, is also generated on the vertical line L2. As a result, all the forces acting on the movable body 32 are generated on the vertical line L2, which includes the intersection P1, and balance out, and no moment is generated that acts to tilt the movable body 32 with respect to the moving direction. Therefore, the inclination angle of the swash plate 23 is changed smoothly.

(2) The flat section 44*a* is configured such that, when the swash plate 23 is at the maximum inclination angle, the intersection P1 is located in the zone Z1, which is surrounded by the sliding portion 32*s*. Therefore, at the maximum inclination angle, or when the movable body 32 generates the greatest drive force, no moment is generated that acts to tilt the movable body 32 with respect to the moving direction. As a result, the inclination angle of the swash plate 23 is readily changed to the maximum inclination angle. Also, the inclination angle of the swash plate 23 is decreased smoothly from the maximum inclination angle.

(3) The guide surface 44 has a flat section 44*a*, which is inclined with respect to the moving direction of the movable body 32. This allows the shape of the guide surface 44 to be simplified. Thus, the guide surface 44 does not need to have a complicated shape for reducing the moment that acts to tilt the movable body 32 with respect to the moving direction. It is thus possible to improve the productivity.

(4) Unlike a variable displacement swash plate type compressor that includes single-headed pistons, the double-headed piston swash plate type compressor, which has the double-headed pistons 25, cannot use the swash plate chamber 24 as a control pressure chamber to change the inclination angle of the swash plate 23. Thus, in the present embodiment, the inclination angle of the swash plate 23 is changed by changing the pressure in the control pressure chamber 35 defined by the movable body 32. Since the control pressure chamber 35 is a small space compared to the swash plate chamber 24, only a small amount of refrigerant gas needs to be introduced to the control pressure chamber 35. This improves the response of change in the inclination angle of the swash plate 23. Since the present embodiment allows the inclination angle of the swash plate 23 to be smoothly changed, the amount of refrigerant gas introduced to the inside of the control pressure chamber 35 is not unnecessarily increased.

The above described embodiment may be modified as follows.

Figure 5:
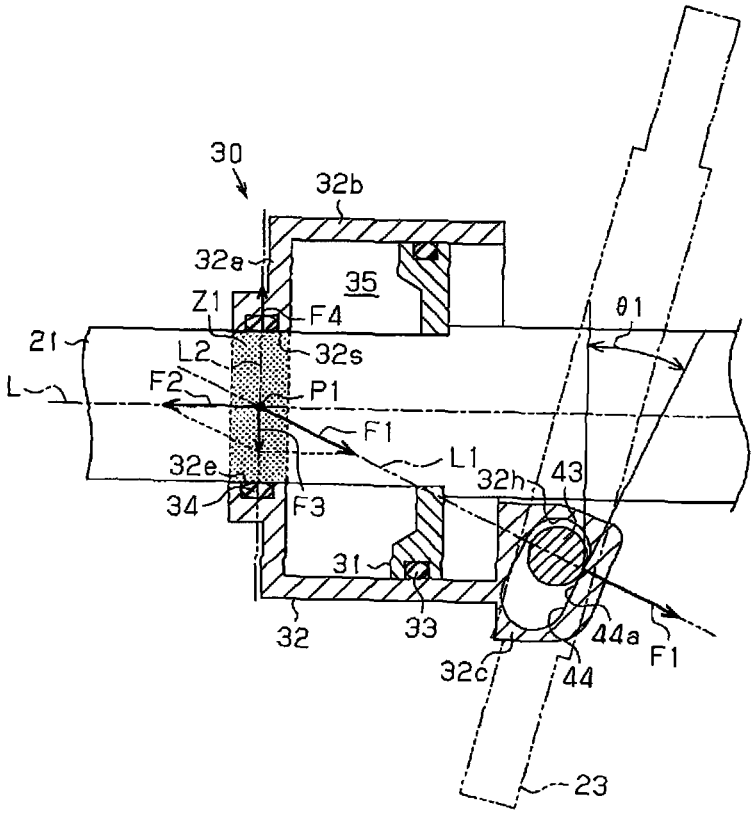
FIG. 5 is a cross-sectional side view illustrating a coupling pin and its surroundings according to another embodiment.

As shown in FIG. 5, the flat section 44*a* may be configured, that is, the gradient of the flat section 44*a* may set such that the intersection P1 is located in the zone Z1, which is surrounded by the sliding portion 32*s*, when the inclination angle of the swash plate 23 is between the minimum inclination angle and the maximum inclination angle. This allows the movable body 32 to move smoothly between the maximum inclination angle and the minimum inclination angle, which is most frequently used in the variable displacement swash plate type compressor 10. Thus, the flow rate control of refrigerant gas introduced into the control pressure chamber 35 is simplified.

Figure 6:
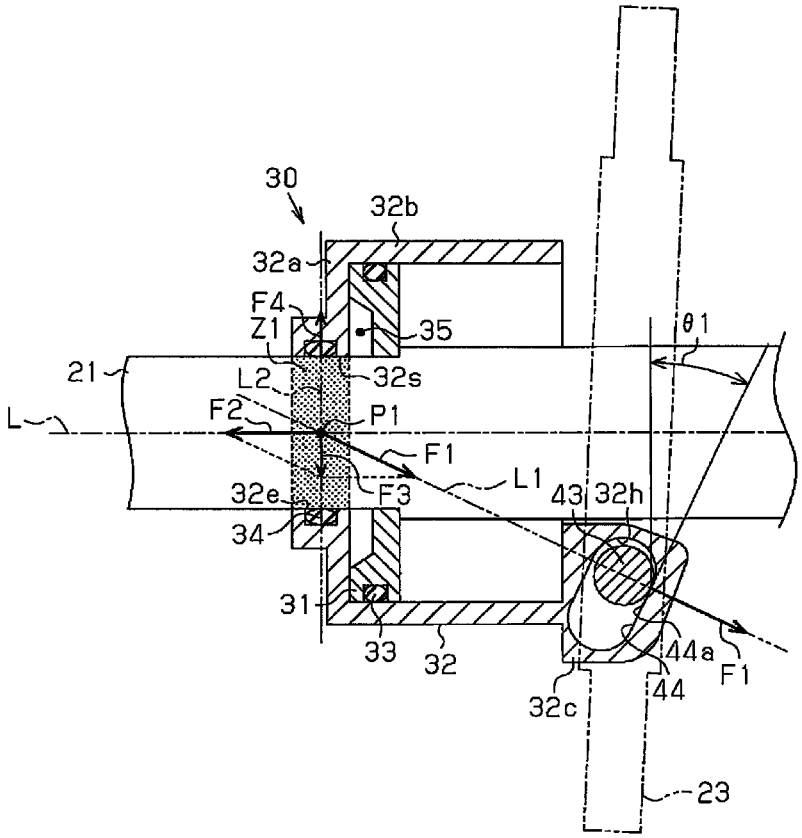
FIG. 6 is a cross-sectional side view illustrating a coupling pin and its surroundings according to another embodiment.

As shown in FIG. 6, the flat section 44*a* may be configured such that, when the swash plate 23 is at the minimum inclination angle, the intersection P1 is located in the zone Z1, which is surrounded by the sliding portion 32*s*. In this configuration, when the inclination angle of the swash plate 23 is the minimum inclination angle, no moment that acts to tilt the movable body 32 with respect to the moving direction is generated. This allows the inclination angle of the swash plate 23 to be increased smoothly when the variable displacement swash plate type compressor 10 starts operating.

Figure 7:
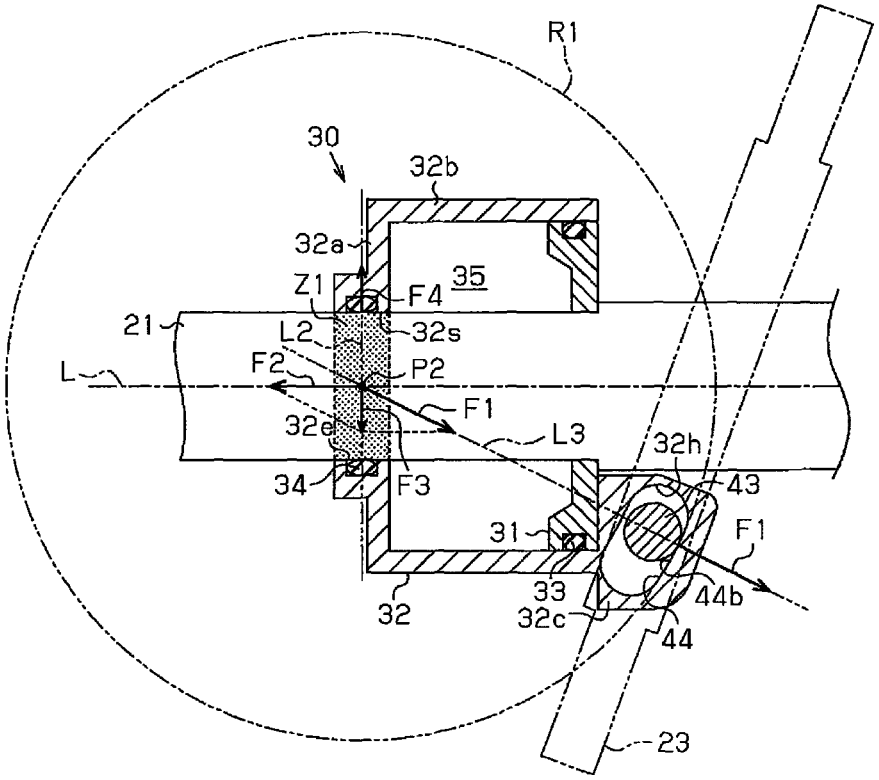
FIG. 7 is a cross-sectional side view illustrating a coupling pin and its surroundings according to another embodiment.

As shown in FIG. 7, the guide surface 44 may include a curved section 44*b*. The curved section 44*b* contacts the coupling pin 43 and has an arcuate shape the center of which is a point on the rotational axis L of the rotary shaft 21. The curved section 44*b* is aligned with an imaginary circle R1 the center of which is a point on the rotational axis L of the rotary shaft 21. When the inclination angle of the swash plate 23 is changed, the intersection P2 of a normal line L3 to the curved section 44*b* and the rotational axis L of the rotary shaft 21 is located in the zone Z1, which is surrounded by the sliding portion 32*s*. The force F1, which is applied to the movable body 32 by the coupling pin 43 in the curved section 44*b*, is generated on the normal line L3. The intersection P2 coincides with the central point of the imaginary circle R1. That is, the curved section 44*b* has an arcuate shape the center of which is the intersection P2. In this configuration, when the coupling pin 43 is guided by the curved section 44*b*, the intersection P2 is unlikely to exit the zone Z1, which is surrounded by the sliding portion 32*s*, at which the rotary shaft 21 and the movable body 32 slide on each other, with respect to the axial direction of the rotary shaft 21, even if the inclination angle of the swash plate 23 changes. Thus, when the inclination angle of the swash plate 23 is changed, the moment that acts to tilt the movable body 32 with respect to the moving direction is easily reduced. This allows the inclination angle of the swash plate 23 to be changed more smoothly.

Figure 8:
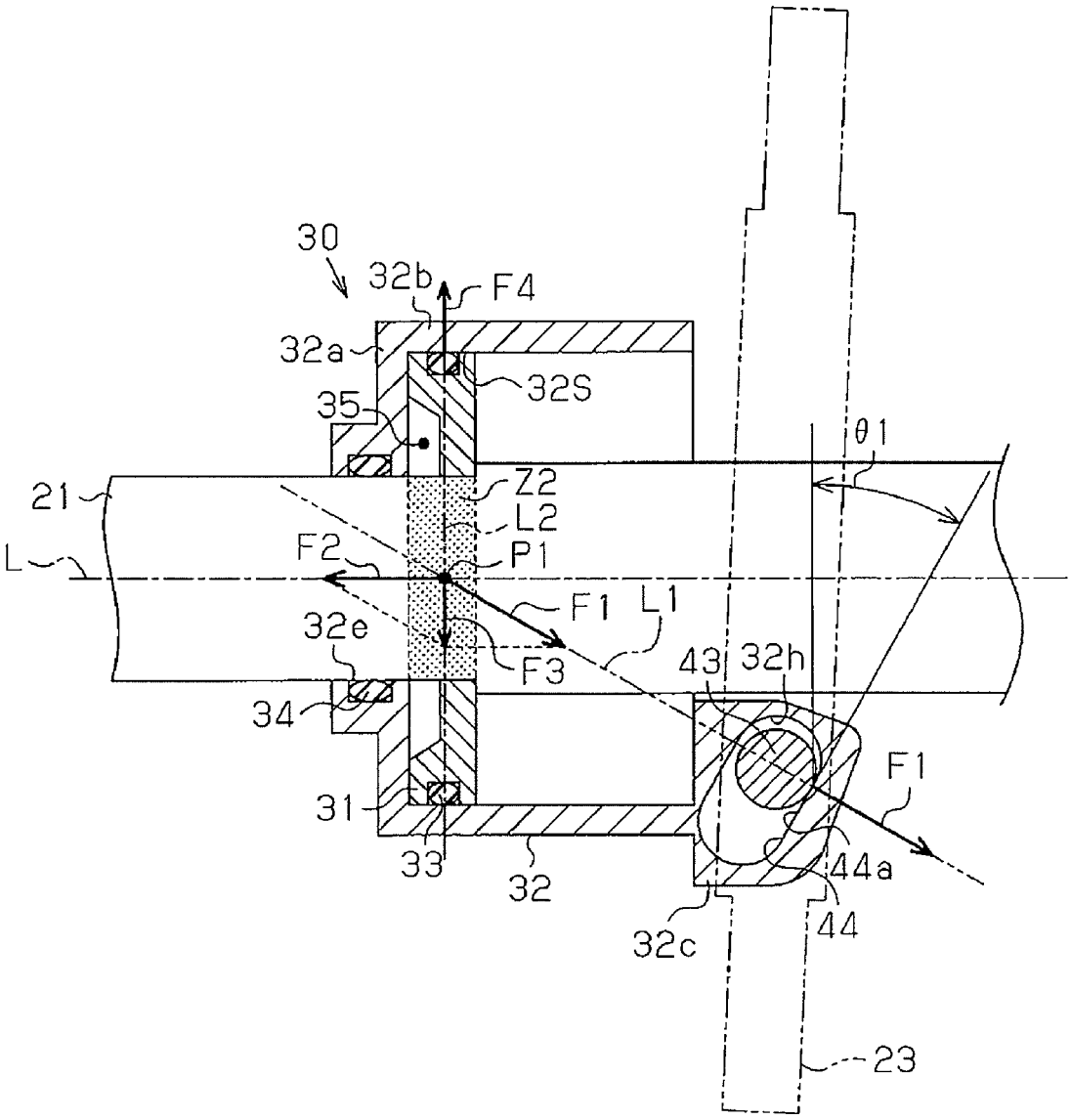
FIG. 8 is a cross-sectional side view illustrating a coupling pin and its surroundings according to another embodiment.

As shown in FIG. 8, the flat section 44*a* may be configured to have such a gradient that, when the inclination angle of the swash plate 23 is the minimum inclination angle, the intersection P1 is located in a zone Z2, which is surrounded by a sliding portion 32S, which slides on the partition body 31 as the movable body 32 moves in the axial direction of the rotary shaft 21. In addition, the flat section 44*a* may be configured such that, when the inclination angle of the swash plate 23 is the maximum inclination angle, the intersection P1 is located in the zone Z2, which is surrounded by the sliding portion 32S, which slides on the partition body 31 as the movable body 32 moves in the axial direction of the rotary shaft 21. Further, the flat section 44*a* may be configured such that, when the inclination angle of the swash plate 23 is between the minimum inclination angle and the maximum inclination angle, the intersection P1 is located in the zone Z2, which is surrounded by the sliding portion 32S, which slides on the partition body 31 as the movable body 32 moves in the axial direction of the rotary shaft 21.

In the illustrated embodiment, the guide surface 44 may include a cam surface that includes the flat section 44*a* and the curved section 44*b*.

In the illustrated embodiment, the through hole 32*h* of the coupling portion 32*c* may be replaced by a groove into which the coupling pin 43 is inserted.

In the illustrated embodiment, the coupling pin 43 may be fixed to the lower end of the swash plate 23 with screws.

In the illustrated embodiment, the coupling pin 43 does not necessary need to be fixed to the lower end of the swash plate 23, but may be inserted into an insertion hole provided in the lower end of the swash plate 23 and slidably held by the insertion hole.

In the illustrated embodiment, an orifice may be provided in the supply passage 37, which connects the pressure adjusting chamber 15*c* and the discharge chamber 15*b* with each other, and an electromagnetic control valve 37*s* may be provided on the bleed passage 36, which connects the pressure adjusting chamber 15*c* and the suction chamber 15*a* with each other.

In the illustrated embodiment, the variable displacement swash plate type compressor 10 is a double-headed piston swash plate type compressor having the double-headed pistons 25, but may be a single-headed piston swash plate type compressor having single-headed pistons.

In the illustrated embodiments, drive power may be obtained from an external drive source via a clutch.

What is claimed is:

1. A variable displacement swash plate type compressor comprising:

a housing, which has a suction chamber, a discharge chamber, a swash plate chamber communicating with the suction chamber, and a cylinder bore;

a rotary shaft, which is rotationally supported by the housing;

a swash plate, which is rotational in the swash plate chamber by rotation of the rotary shaft;

a link mechanism arranged between the rotary shaft and the swash plate, wherein the link mechanism allows for a change of an inclination angle of the swash plate with respect to a first direction that is perpendicular to a rotational axis of the rotary shaft;

a piston reciprocally received in the cylinder bore;

a conversion mechanism, which causes the piston to reciprocate in the cylinder bore by a stroke corresponding to the inclination angle of the swash plate through rotation of the swash plate;

an actuator, which is located in the swash plate chamber and changes the inclination angle of the swash plate; and a control mechanism, which controls the actuator, wherein the actuator includes a partition body provided on the rotary shaft, a movable body, which is located in the swash plate chamber and movable along the rotational axis of the rotary shaft, a control pressure chamber, which is defined by the partition body and the movable body, the movable body is configured to move by at least one of introducing a refrigerant from the discharge chamber to the control pressure chamber and by discharging the refrigerant from the control pressure chamber to the suction chamber, and a coupling member, which is located between the movable body and the swash plate and in a peripheral portion of the swash plate, the movable body includes a guide surface, which guides the coupling member and changes the inclination angle of the swash plate as the movable body moves along the rotational axis of the rotary shaft, and a sliding portion, which slides on the rotary shaft or the partition body as the movable body moves along the rotational axis of the rotary shaft, and the guide surface is configured such that a perpendicular line or a normal line to the guide surface and the rotational axis of the rotary shaft intersect with each other in a zone surrounded by the sliding portion when viewed in a direction that is perpendicular to a direction in which the rotational axis of the rotary shaft extends and perpendicular to the first direction.

2. The variable displacement swash plate type compressor according to claim 1, wherein the guide surface is configured such that, when the inclination angle of the swash plate is a maximum inclination angle, the perpendicular line or the normal line to the guide surface and the rotational axis of the rotary shaft intersect with each other in the zone surrounded by the sliding portion when viewed in the direction that is perpendicular to the direction in which the rotational axis of the rotary shaft extends and perpendicular to the first direction.

3. The variable displacement swash plate type compressor according to claim 1, wherein the guide surface is configured such that, when the inclination angle of the swash plate is between a minimum inclination angle and a maximum inclination angle, the perpendicular line or the normal line to the guide surface and the rotational axis of the rotary shaft intersect with each other in the zone surrounded by the sliding portion when viewed in the direction that is perpendicular to the direction in which the rotational axis of the rotary shaft extends and perpendicular to the first direction.

4. The variable displacement swash plate type compressor according to claim 1, wherein the guide surface is configured such that, when the inclination angle of the swash plate is a minimum inclination angle, the perpendicular line or the normal line to the guide surface and the rotational axis of the rotary shaft intersect with each other in the zone surrounded by the sliding portion when viewed in the direction that is perpendicular to the direction in which the rotational axis of the rotary shaft extends and perpendicular to the first direction.

5. The variable displacement swash plate type compressor according to claim 1, wherein the guide surface includes a flat section, and the flat section is configured such that the perpendicular line to the guide surface and the rotational axis of the rotary shaft intersect with each other in the zone surrounded by the sliding portion when viewed in the direction that is perpendicular to the direction in which the rotational axis of the rotary shaft extends and perpendicular to the first direction.

6. The variable displacement swash plate type compressor according to claim 5, wherein a gradient of the flat section is set such that the perpendicular line to the guide surface and the rotational axis of the rotary shaft intersect with each other in the zone surrounded by the sliding portion.

7. The variable displacement swash plate type compressor according to claim 1, wherein the guide surface includes a curved section, and the curved section is configured such that the normal line to the guide surface and the rotational axis of the rotary shaft intersect with each other in the zone surrounded by the sliding portion when viewed in the direction that is perpendicular to the direction in which the rotational axis of the rotary shaft extends and perpendicular to the first direction.

* * * * *